US006827293B2

(12) United States Patent
Seeman

(10) Patent No.: US 6,827,293 B2
(45) Date of Patent: Dec. 7, 2004

(54) SPRAY HEAD FOR MIXING PAINT CONCENTRATE WITH SERVICE WATER DURING PAINT APPLICATION

(76) Inventor: George Seeman, 14248 SE Fairwood Blvd., Renton, WA (US) 98058

( * ) Notice: Subject to any disclaimer, the term of this patent is extended or adjusted under 35 U.S.C. 154(b) by 0 days.

(21) Appl. No.: 10/329,639

(22) Filed: Dec. 26, 2002

(65) Prior Publication Data

US 2004/0124263 A1 Jul. 1, 2004

(51) Int. Cl.[7] ..... B05B 7/26
(52) U.S. Cl. ..... 239/310
(58) Field of Search ..... 239/19, 22, 61, 239/63, 302, 308, 310, 312, 317, 318, 416.2, 416.3, 416.4, 416.5

(56) References Cited

U.S. PATENT DOCUMENTS 3,231,200 A * 1/1966 Heald ..... 239/318
3,259,321 A * 7/1966 Sellers ..... 239/310
3,776,468 A * 12/1973 Davenport ..... 239/310
5,133,498 A * 7/1992 Sealy et al. ..... 239/68
5,419,495 A * 5/1995 Berfield ..... 239/305
5,671,887 A * 9/1997 Iavarone ..... 239/310
6,003,786 A * 12/1999 Schwary ..... 239/310
6,068,204 A * 5/2000 Alexander ..... 239/310
6,116,521 A * 9/2000 Miyake ..... 239/310
6,283,385 B1 * 9/2001 Beaver et al. ..... 239/10
6,419,166 B1 * 7/2002 Brzezinski et al. ..... 239/310
6,604,546 B1 * 8/2003 Gilmore ..... 137/550

* cited by examiner

*Primary Examiner*—Gene Mancene
*Assistant Examiner*—Thach H Bui
(74) *Attorney, Agent, or Firm*—David L. Tingey

(57) ABSTRACT

An apparatus adapted to mix in a mixing chamber within the apparatus a waterless paint concentrate maintained in a reservoir within the apparatus. The concentrate is stored in the reservoir in a concentration unsuitable for application to a paintable surface. The concentrate is mixed with water received into the mixing chamber under external waterline pressure forming a paint suitable for application to a paintable surface. The paint is then discharged from the apparatus through a spray nozzle. Mixing occurs in the apparatus concurrently with discharge through the nozzle as water flows through the apparatus. The apparatus as largely a container of waterless paint concentrate with a simple mix and discharge spray head attached is disposable after consumption of the concentrate without need for cleaning.

18 Claims, 4 Drawing Sheets

SPRAY HEAD FOR MIXING PAINT CONCENTRATE WITH SERVICE WATER DURING PAINT APPLICATION

BACKGROUND

1. Field Of The Invention

The invention relates to a device and method for mixing a water-dilutable, water-free paint concentrate with water at the time of spraying onto a paintable surface.

2. Prior Art

A water-dilutable paint such as latex and water-dilutable acrylic paint comprises primarily coloring pigments in a resin ("Paint" and "stain" are used interchangeably and meant to include all manner of paints, stains and all other liquid compounds applied to color, protect, or cover a surface with a film or absorbent). Several other components can be added such as wetting agents and antifoams, and extenders. These components are mixed in water to a viscosity suitable for application by spraying or by brush or roller. Paint components mixed in water decompose in time and also tend to settle to the bottom. To counter this decomposition and settling, a paint stabilizer is also added. The stabilizer and other additives dilute the paint.

Water-dilutable paint typically comprises a high proportion of water and a low proportion of paint concentrate. The mixed paint is packaged, transported, stored, and applied with this high proportion of water, increasing cost and inconvenience of dealing with weight and volume increased by the water over the paint ingredients. It would be advantageous to maintain the paint ingredients unmixed from the water until the paint is applied. Water is generally available for mixing with these paint ingredients at the place of application of the paint. This would eliminate the need for stabilizers and greatly reduce the volume and weight of the paint to its essential elements.

It is the primary object of the present invention, therefore, to have a paint concentrate without water that is first mixed with water at the time of spray delivery of the paint to a paintable surface.

SUMMARY

This object is achieved in a water-tight unpressurized reservoir of constant volume containing the water-dilutable paint concentrate without water and a head typically secured to the reservoir, although conceivably the head can be detached with a tube between them. The head comprises a mixing chamber, a spray nozzle that directs and atomizes the paint composition, and a conduit attachment to which a water conduit is attached, typically a household garden hose. In operation, water typically under waterline pressure is delivered through the garden hose to the mixing chamber and out the spray nozzle. Concentrate from the reservoir is siphoned or otherwise extracted from the reservoir into the mixing chamber, such as by gravity feed, where it mixes with water passing through in an aqueous solution approximately one part paint/stain solids to three to twenty parts water. A valve regulates flow from the reservoir.

Typically, the valve also regulates flow of water in a three-way valve, including a fully closed position where no water or concentrate flows, an opened position where water and concentrate flow for mixing and delivery through the nozzle suitable for spray application, and a water flow position, where the concentrate is closed but water continues to flow for flushing the mixing chamber and nozzle for cleaning purposes. With water flowing unmixed through the spray nozzle, the directed flow is advantageous for clean up, for example, of overspray until the paint is dry. A surface inadvertently painted can usually be washed clean of sprayed paint with clear water from the nozzle during the first ten minutes after application. This facilitates not only the clean up but also the painting process. It becomes more efficacious to not even cover or otherwise prepare adjoining surfaces and ignore overspray during the painting process. Then using the clear water pass through mode of operation, water is directed onto the overspray area which washes it clean. Clear water that might mist or slightly splatter onto the painted area is unaffected by the water. If one chooses, a board may be briefly held between the painted area and the overspray area in the near vicinity of clear water clean up.

For purposes within, "waterless" or "water free" or the like is meant to mean water restricted and without water added but recognizing that paint ingredients may naturally have water within a compound. "Resin" is meant to include all water-dilutable resins forming a film when applied to a paintable surface. Water soluble resins typically contain carboxyl groups that make them water-dilutable. They can be any of many commercially available resins. Once specific example is known commercially as NeoCryl XK-90. "Pigment" is meant to include any and all inorganic and organic compounds and metallic powders employed to provide cover, color effect and cover. Two well-known commercially-available pigments are SGS yellow iron oxide 115 (yellow iron oxide) and SGS red iron oxide 417 (red iron oxide). The resin and pigments as the primary concentrate ingredients are combined in a paint or stain composition, meant to include all forms of combination of paint ingredients, such as mixtures, solutions, emulsions, dispersions and suspensions. Water dilutable is also meant to include water soluble and any of these combinations of ingredients with water. Other additives, meant to include all other ingredients such as stabilizers, antifoamants, anticratering additives, wetting agents for dispersion of the pigment, binders and the like, are added to render the concentrate applicable to a paintable surface.

Table 1 following represents a typical 1-gallon formula of paint concentrate.

TABLE 1

Concentrate Formula, 1 Gallon

| Ingredient | Lbs./Gal |
|---|---|
| Propylene Glycol | 0.2 |
| Nuosept 95 | 0.008 |
| Nuocide 960 | 0.008 |
| AMP-95 | 0.01 |
| Surfynol CT-111 | 0.016 |
| Tinuvin 1130 | 0.04 |
| Lactimon WS | 0.047 |
| Attagel 50 | 0.05 |
| BYK 022 | 0.006 |
| BYK 024 | 0.006 |
| Minex 4 | 0.6 |
| SGS YO 115 | 4.634 |
| SGS RO 417 | 0.724 |
| NeoCryl XK-90 | 3.092 |
| NeoCryl A-639 | 2.293 |
| NeoRez R-9649 | 0.097 |
| Texanol | 0.135 |
| Solvent EB | 0.135 |
| Bentolite WH | 0.013 |

These formula ingredients are understood as follows:

a. Propylene Glycol (dihydric alcohol) is used as an esterifying agent (a process involving the interaction of a compound possessing a hydroxyl group with an acid, with the elimination of water. This ingredient is used to help the stain form a film and it also acts as an anti-freeze. It is also used as a wet-edge additive.

b. Nuosept 95 (formaldehyde bicyclic oxazolidines) is a preservative used to prevent the stain from growing bacteria and fungus while it is in storage in its container.

c. Nuocide 960 (chlorothalinil) is a fungicide and algaecide used to prevent mold and mildew from growing on the surface of the stain or paint after it is applied to a paintable surface such as a house or a fence. Although acrylic stains are not prone to attract mold and mildew growth in dry climates, this ingredient helps prevent the normal occurrence of mold and mildew that might occur in damp climates, such as the Pacific Northwest.

d. Amp 95 (2-amino-2-methyl-1-propanol) is used as a pigment dispersant or stabilizer that increases the stability of a suspension of pigments in the stain and also as a pH modifier. Without a dispersant the pigments tend to settle to the bottom of a composition and water based coatings need to have a certain pH for the paint/stain to form a film on the paintable surface.

e. Surfynol CT-111 (alkoxylated acetylenic diol) is used as a surfactant. Most pigments in the dry state contain bound agglomerates of primary particles. A primary particle is one of optimum size of pigment structure that achieves the best color development. In order to disperse these primary particles in water, they are subjected to deagglomeration to break up the agglomerates, wetting to disperse the pigment from the resin surface, and stabilization to maintain the pigment throughout the resin. This additive reduces surface tension and improves wetting, thereby helping to disperse pigments and inhibit foaming or emulsifying.

f. Tinuvin 1130 (hydroxyphenyl benzotriazole) is a liquid ultra-violet radiation absorber used as a light stabilizer to protect the substrate from the harmful effects of the sun.

g. Lactimon WS (a solution of a partially neutralized alkylammonium salt of a polycarboxylic acid polymer and a polydimethylsiloxane) used as a wetting and dispersing deflocculating additive to improve pigment wetting and to stabilize the pigment dispersion preventing flooding and floating and improving gloss. It contains a polysiloxane copolymer which helps to prevent pigment separation and in particular helps to counteract formation of Benard cells and pigment striations.

h. Attagel 50 (attapulgite crude) is a colloidal, inorganic mineral thickener that is essentially inert and non-swelling in aqueous applications. When dispersed in water, it displays unique thixotropic (gelling) properties that promotes anti-settling and drip and sag control.

i. BYK 022 (composition of hydrophobic solids, emulsifiers and foam destroying polysiloxanes in polyglycol) is a silicone defoamer for aqueous coatings.

j. BYK 024 (emulsion of hydrophobic solids, emulsifying agents and foam destroying polysiloxanes) is a silicone defoamer for aqueous coatings. T k. Minex 4 (nepheline syenite) is used as an extender and a filler. It is an achromatic pigment of low refractive index in a range of 1.5 to 1.6. Consequently, it does not contribute significantly to the hiding power of the paint/stain. It is used to reduce cost, achieve durability, and alter appearance (e.g., decrease in gloss).

l. SGS Yellow Iron Oxide 115 (SGS YO; yellow iron oxide) is a yellow pigment dispersion. These are finely ground synthetic insoluble dispersed particles which, when dispersed in a liquid vehicle to make paint, also enhances paint-opacity, hardness, durability, and corrosion resistance. As great ultraviolet absorbent colorants, oxide pigments are also are one of the best ingredients to protect a surface from damaging effects of the sun.

m. SGS Red Iron Oxide 417 (red iron oxide) is a red pigment dispersion. As with SGS YO, these are also finely ground synthetic insoluble dispersed particles which, when dispersed in a liquid vehicle to make paint, also enhances paint-opacity, hardness, durability, and corrosion resistance and are one of the best ingredients to protect a surface from damaging effects of the sun.

n. Neocryl XK-90 (acrylic copolymer emulsion) as a resin holds the pigments to the paintable surface. It is a 100% acrylic emulsion polymer designed for exterior paints and stains. It provides excellent color development and early block resistance and outstanding wet adhesion to aged and chalked alkyds. Its unique small particle morphology gives hard durable stains with cosolvent demands as low as 3.5% on resin solids. Blocking is the undesirable sticking together of two painted surfaces when pressed together under normal conditions or under specified conditions of temperature, pressure and relative humidity. Without block resistance, for example, the stained gate on a fence may stick shut even after the stain has already dried o. Neocryl A-639 (acrylic polymer) also is an acrylic copolymer resin that holds the pigments to the paintable surface that is used to formulate pigmented industrial coatings for wood substrates. It exhibits excellent chemical resistance, hardness, and good block resistance.

p. NeoRez R-9649 (water-borne urethane) is a coating vehicle that contains a polyisocyanate monomer reacted to yield polymers containing a combination of urethane linkages, active isocyanate groups or polyisocyante monomers. It exhibits very low coeffecient of friction and excellent rub resistance. It also exhibits excellent water and stain resistance.

q. Texanol (ester alcohol: 2,2,4-Trimethyl-1,3-pentanediol Monoisobutyrate) is a slow evaporating, water-insoluble coalescing aid for water-borne paints. It provides good scrub resistance, color development, and package stability. It is an excellent coalescing aid for emulsion polymers and has excellent hydrolytic stability, allowing it to be used with a wide variety of latex emulsions including high pH acrylics. When added to emulsion paint, it is absorbed by the emulsions polymeric particles, softening them and causing complete fusion when the paint film dries. Since Texanol is insoluble in water and therefore is not in a water phase, applying the paint over a porous substrate does not result in reduced coalescing efficiency because it is not absorbed by the substrate along with the water.

r. Solvent EB (ethylene glycol monobutyl ether) is necessary for the paint/stain to form a film. It is a colorless liquid soluble in alcohol and water having a high dilution ratio with petroleum hydrocarbons. It oxides slowly when exposed to air, particularly at elevated temperatures. p0 s. Bentolite WH (bentolite) swells in water and is used as a thickening agent. It is a very fine-grained clay derived from volcanic ash and consisting largely of montmorillonite mineral.

DETAILED DESCRIPTION OF THE PREFERRED EMBODIMENTS

Figure 1:
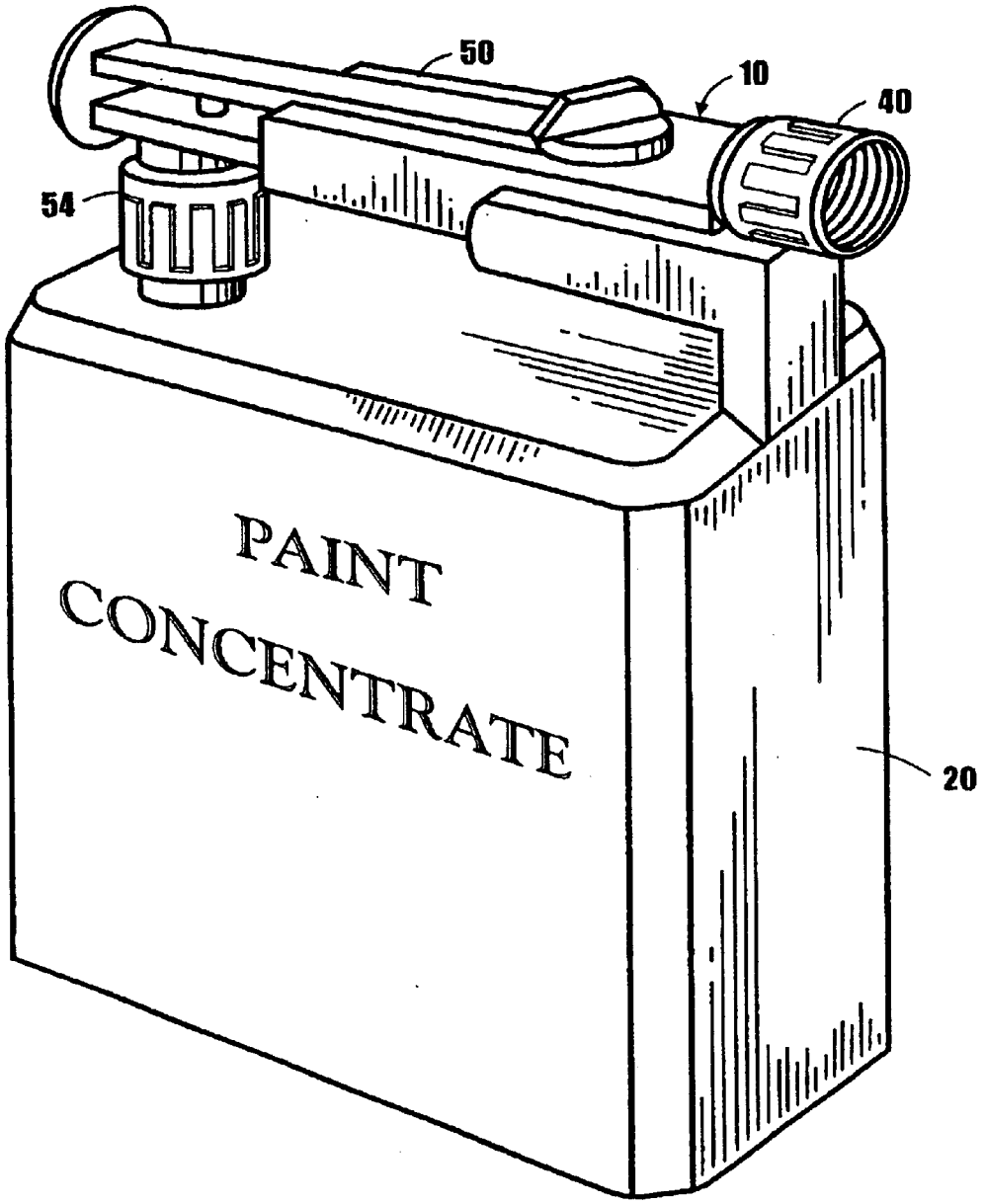
FIG. 1 is a perspective view of the apparatus of the present invention.
Figure 2:
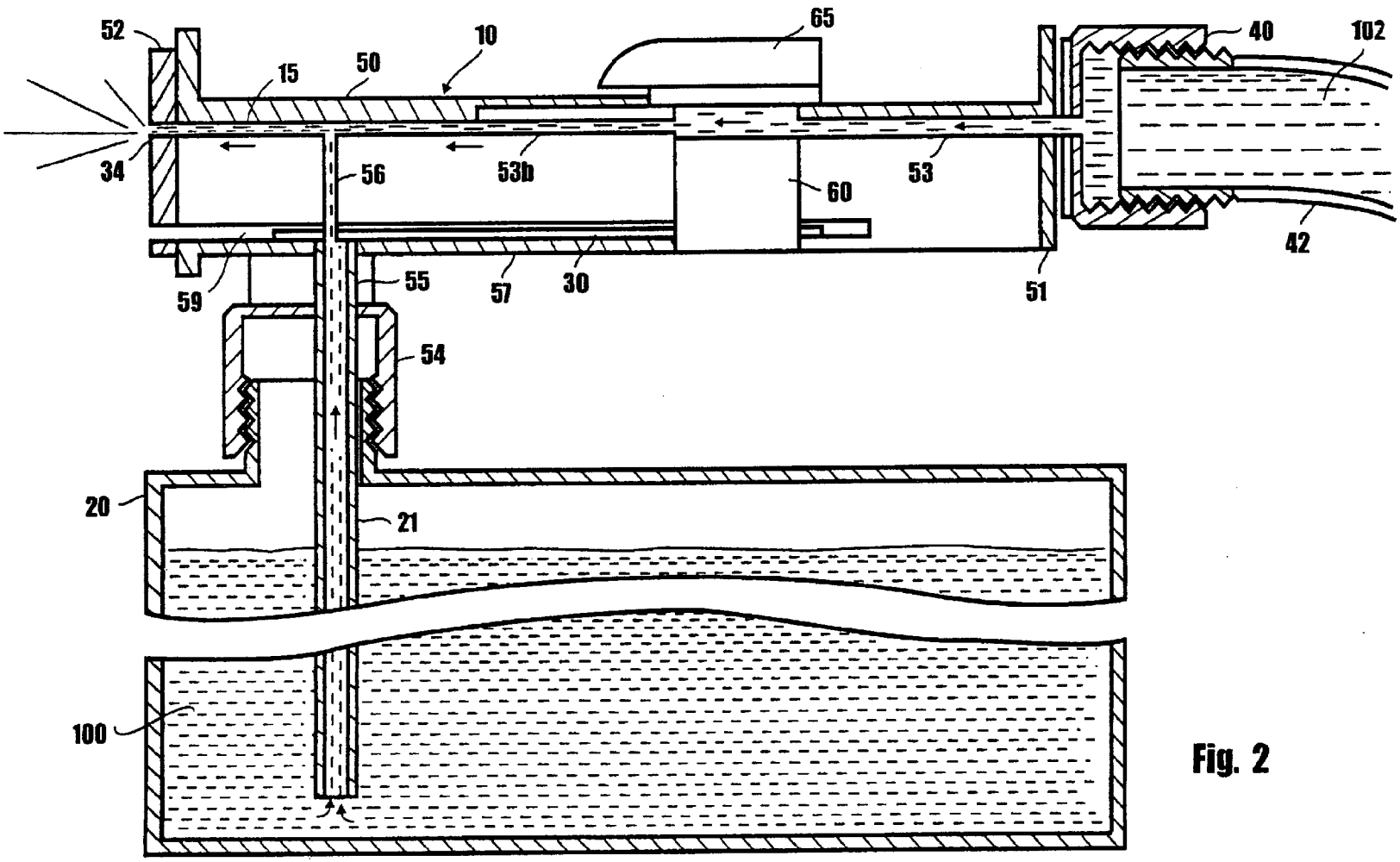
FIG. 2 cut-away side view of the apparatus of FIG. 1 shown with paint concentrate inside and a water hose connected.
Figure 3:
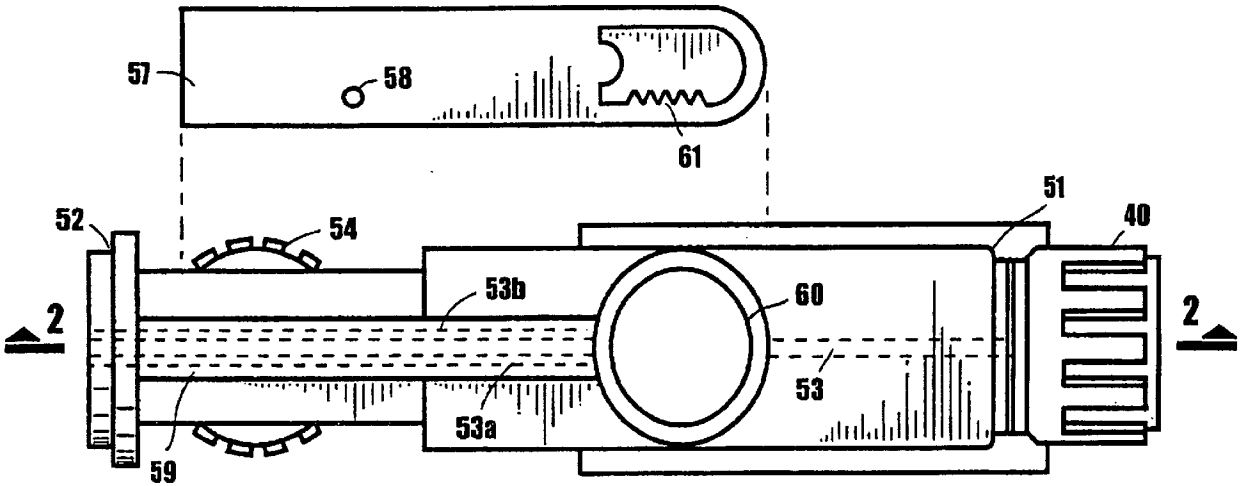
FIG. 3 is a top plan view of the apparatus of FIG. 1 shown with a valve slide outside but aligned longitudinally.
Figure 4:
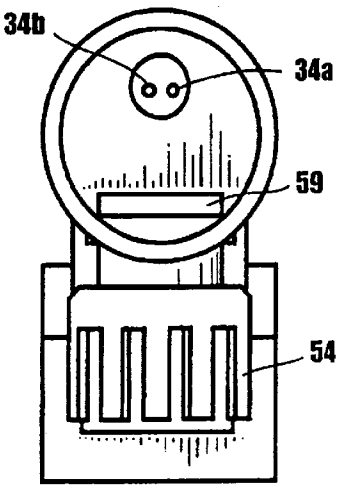
FIG. 4 is a front end view of the apparatus of FIG. 1.
Figure 5:
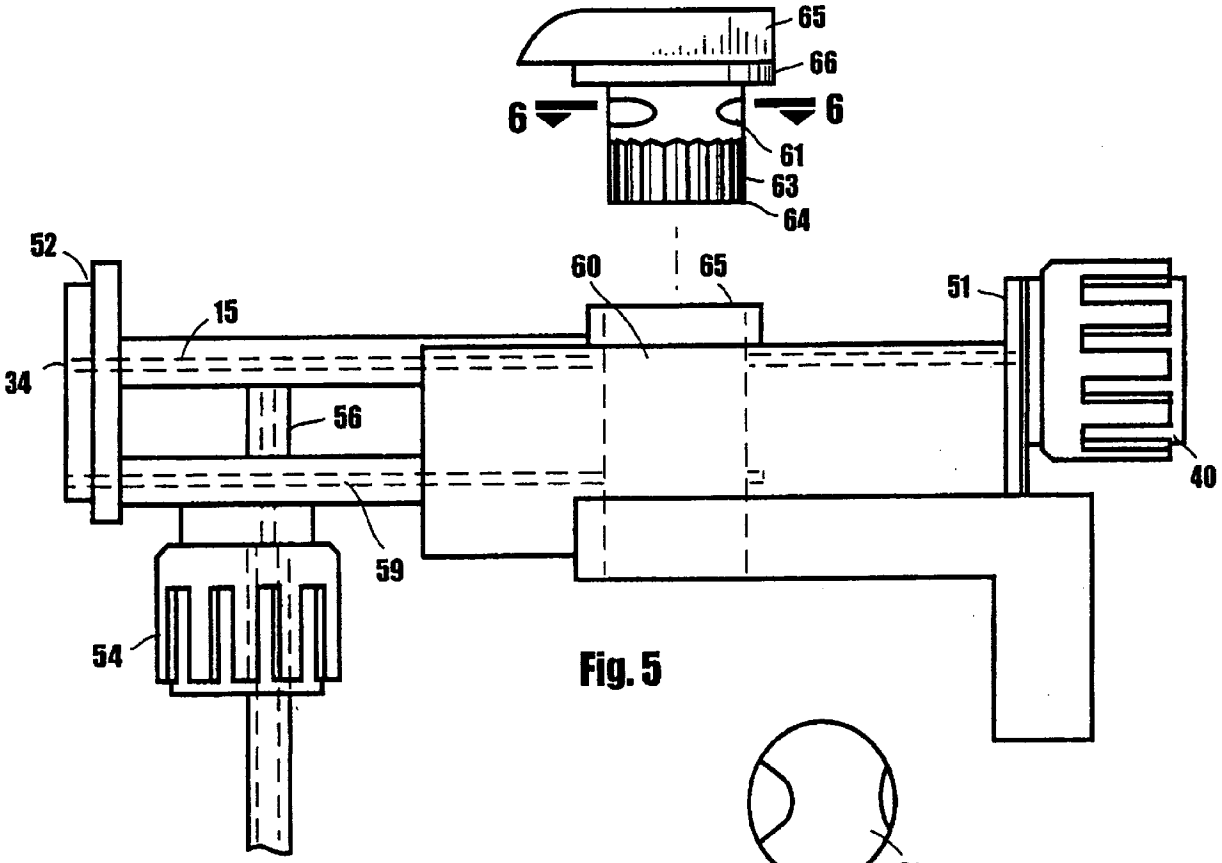
FIG. 5 is a side plan view of the apparatus of FIG. 1.
Figure 6:
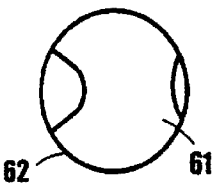
FIG. 6 is a top view of the valve stem divider.

The present portable paint spray gun apparatus for spraying water dilutable paint is adapted to store a paint concentrate 100 and mix the paint concentrate 100 with water 102 flowing through the apparatus 10 to form a paint suitable for application to a paintable surface. The apparatus 10 mixes the paint concentrate 100 in a mixing chamber 15 within the apparatus 10 only immediately prior to spraying the mixed paint to that paintable surface. Until the concentrate 100 is mixed with water 102, it is in a concentration unsuitable for application to a paintable surface. Typically, the concentrate 100 comprises between fifty and seventy percent (50–70%) solids (nonvolatile matter in a stain or paint composition that remains after drying to constitute a dry film).

Typically, the resin is at least 33% and the pigment is at least 50% of the concentrate total weight. After mixing with water, the composition comprises approximately 3 to 20 parts of water by volume for each part concentrate.

The apparatus comprises a reservoir 20 in which the water-dilutable paint concentrate 100 is contained until mixed with water 102 at the time of application. The paint concentrate includes a paint resin and a paint pigment at high percentage of solids without water as its major ingredients by weight. A valve 30 in fluid communication with the reservoir 20 prevents water from entering the reservoir 30, which would contaminate the concentrate 100, thus maintaining the concentrate 100 substantially without water. The valve 30 includes a first, or open, position that provides fluid communication between the reservoir 20 and the mixing chamber, a second, or closed, position that blocks fluid combination between the reservoir 20 and the mixing chamber 15 while continuing to provide, fluid communication between a water attachment fixture 40 and the mixing chamber 15.

The mixing chamber 15 is in fluid communication with the valve 30 with the valve 30 between the reservoir 20 and the mixing chamber 15. The valve 30 thus regulates flow of concentrate 100 from the reservoir 20 to the mixing chamber 15.

Pressurized water 102 is provided from an external conduit 42, typically a garden hose under waterline pressure, which is attached to the mixing chamber 15 at the water attachment fixture 40, feeding water 102 into the and through the mixing chamber 15. A spray nozzle 34, through which said paint concentrate is sprayed, typical in paint spray guns, in fluid communication with the mixing chamber 15, receives the mixed paint composition from the mixing chamber 15 which is then discharged through the nozzle 34.

Thus, paint concentrate 100 flows from the reservoir 20 through the valve 30 and into the mixing chamber 15 when the valve is in a first, or open, position. The concentrate 100 then mixes with water 102 fed from the attached water conduit 42 under pressure forming a water dilutable paint composition. Flow of the concentrate 100 is such as to yield a composition of a suitable concentration capable of application to a paintable surface to form a dried coating of paint.

Typically, the mixing chamber 15, valve 30, water attachment fixture 40 and spray nozzle 34 comprise a spray head 50 that attaches to the reservoir 20. The water attachment fixture 40 is at a spray head first end 51 and the spray nozzle 34 at a spray head second end 52 with a straight passageway 53 between them through which water 102 passes. A valve stem 62 in a head vertical bore 60 has a channel divider 61 that divides the straight passageway from the water attachment fixture 40 into first and second passageways 53*a* and 53*b* ending in first and second spray nozzles 34*a* and 34*b*. For mixture with paint concentrate 100, the valve stem 62 is turned to a first position direct water 102 into first passageway 53*a*. For water passage through the head and out the nozzle 34 without mixture with concentrate 100, the valve stem 62 is turned to direct water 102 into either or both first and second passageway 53*a* and 53*b* and out either or both first and second nozzles 34*a* and 34*b*, the second position flushing passageway 53*a* with water and the third position directing water through second passageway 53*b*.

A reservoir attachment fixture 54 is adapted to attach to a matching reservoir port 55. A valve tube 56 provides fluid communication between the first passageway 53*a* and the reservoir attachment fixture 54. A reservoir conduit 21 extending into the reservoir 20 attaches to the reservoir attachment fixture 54 effectively extending the valve tube 56 into the reservoir 20. As concentrate 100 is then drawn from the reservoir 20 through the valve tube 56 into the passageway 53, it mixes with water passing through the first passageway 53*a* between the valve tube 56 and the nozzle, that portion of the first passageway 53*a* comprising the mixing chamber 15.

A valve slide 57 with a vertical valve hole 58 therethrough slides transverse to the valve tube 56 between the first passageway 53*a* and the reservoir attachment fixture 54 between open and closed positions in a head channel 59 that runs from the valve tube 56 to the head vertical bore 60 that intersects the passageway 53. In the open position the hole 58 is in alignment with the valve tube 56. In other valve positions, the valve slide 57 slides out of alignment of the valve hole 58 with the valve tube 56, including the second and third, or closed and through positions described above. The valve slide 57 includes a rack 61 at its end intersecting the head vertical bore 60. Valve stem 62 fits snugly in the head vertical bore 60 and includes a pinion 63 on its bottom end 64 that meshes with the valve slide rack 61. A valve handle 65 fits on a valve stem top end 66 to turn the valve stem 62, adapted such that as the valve handle 65 turns the valve stem 62, the valve pinion 63 engages the valve slide rack 61 causing the valve slide 57 to slide in the channel 59 therein bringing the valve hole 58 into and out of alignment with the valve tube 56.

The simplicity of design lends itself to low-cost production with disposable capability. The design reduces to a container with an expensive spray head. A concentrate must be marketed in some container anyway. The addition of a low cost spray head is the only additional cost. Compared with the cost of a spray gun and larger containers that would otherwise be required with premixed paint/stain, the spray head becomes the less costly alternative. With no intent to clean the apparatus, but instead throw it away after first and only use rather than refilling the reservoir, a simplified two-way valve opening and closing the reservoir is all that is required. The water from the water conduit can be opened and closed with the same valve positioning or controlled externally at the water source.

In operation then, until paint is to be applied to a paintable surface, paint concentrate is maintained apart from water in the reservoir. Just prior to painting, a conduit, normally a garden hose is attached to the paint head under waterline pressure and turned on with the valve closed. The valve is opened to its first position and concentrate begins to flow, either by siphon or by gravity feed, into the mixing chamber where it mixes with water flowing through the mixing chamber in the preferred ratio of 1:15–17 simultaneously as the mixed composition is discharged through the nozzle, directed toward a paintable surface. When the water evaporates, a dry film of paint remains on or absorbed into the surface, or both. Upon completing a painting period, the valve is turned to its second position to flush the paint composition from the mixing chamber and nozzle, blocking concentrate flow from the reservoir while allowing water to flow through the mixing chamber and nozzle.

It is to be understood that these embodiments merely exemplify the invention. One skilled in the art will recognize that various modifications and adaptations can be made in the device as described and the method of employing this or another device to exploit the invention. Such modifications and adaptations within the ability of one skilled in the art are deemed to be within the scope of the present application.

Having described the invention, what is claimed is as follows:

1. A portable paint spray gun with a valved concentrate reservoir with a waterless paint concentrate maintained in the reservoir within the apparatus in a concentration unsuitable for application to a paintable surface with water, the reservoir sealable under valve control therein denying water from entering and mixing with the concentrate in the reservoir therein precluding contamination of the concentrate by water which would otherwise cause the concentrate to degrade during storage in the reservoir, the concentrate metered from the reservoir into a mixing chamber where it is mixed with water forming a paint suitable for application to a paintable surface, the paint discharged from the spray gun through a spray nozzle, mixing occurring concurrently with discharge as water flows through the apparatus.

2. A portable paint spray gun for spraying water dilutable paint and adapted to mix, within the spray gun, a paint concentrate and water flowing through the spray gun to form a paint suitable for application to a paintable surface only immediately prior to spraying the mixed paint to that paintable surface, comprising, a reservoir sealable against water under valve control containing water-dilutable paint concentrate which paint concentrate includes a paint resin and a paint pigment, configured to deny access of water to the concentrate while the concentrate is within the reservoir, a valve in fluid communication with the reservoir;

a mixing chamber in fluid communication with the valve with the valve between the reservoir and the mixing chamber regulating flow of concentrate from the reservoir, a water attachment fixture in fluid communication with the mixing chamber to which a water conduit may be attached and through which water may be delivered under pressure, a spray nozzle in fluid communication with the mixing chamber through which said paint concentrate is sprayed, wherein the paint concentrate is stored waterless and water-tight in the reservoir until time of application at which time the paint concentrate flows from the reservoir through the valve and into the mixing chamber when the valve is in a first, or open, position therein mixing with water when said water conduit is attached to said water attachment fixture with water delivered under pressure through said water conduit forming a water dilutable paint composition of suitable concentration capable of application to a paintable surface to form a dried coating of paint.

3. The apparatus of claim 2 wherein the valve is configured to deny access of water to the concentrate while the concentrate is within the reservoir.

4. The apparatus of claim 2 wherein the valve comprises an integral three-way valve including a first, or open, position providing fluid communication between the reservoir and the mixing chamber, a second, or closed, position wherein fluid combination between the reservoir and the mixing chamber is blocked, and a third position providing fluid communication between the water attachment fixture and the mixing chamber while blocking fluid communication between the mixing chamber and the reservoir.

5. The apparatus of claim 2 wherein the resin is at least 33% of the concentrate total weight.

6. The apparatus of claim 2 wherein the pigment is at least 40% of the concentrate total weight.

7. The apparatus of claim 2 in which the concentrate is without water in a concentration unsuitable for application to a paintable surface.

8. The apparatus of claim 2 in which said concentrate comprises at least fifty percent solids.

9. The apparatus of claim 2 in which in said composition there is approximately 3 to 20 parts of water by volume for each part concentrate.

10. For a portable paint spray gun comprising a reservoir containing water-dilutable paint concentrate which paint concentrate includes a paint resin and a paint pigment substantially without water a mixing chamber in fluid communication with the reservoir, a water attachment fixture in fluid communication with the mixing chamber to which a water conduit may be attached and through which water may be delivered under pressure, a spray nozzle in fluid communication with the mixing chamber through which said paint concentrate is sprayed, a valve in fluid communication between the reservoir and the mixing chamber configured to deny access of water to the concentrate while the concentrate is within the reservoir and regulating flow of concentrate from the reservoir, wherein paint concentrate flows from the reservoir through the valve and into the mixing chamber when the valve is in a first, or open, position therein mixing with water when said water conduit is attached to said water attachment fixture with water delivered under pressure through said water conduit forming a paint composition of suitable concentration for application to a paintable surface, the method of mixing paint concentrate with water just prior to a moment of discharge of the composition from the spray nozzle, comprising the following steps:

a. Attaching a water conduit to the water attachment;

b. Opening water into the water conduit under water pressure;

b. Opening water into the water conduit under water pressure;

c. Turning the valve to establish fluid communication and concentrate flow between the reservoir and the mixing chamber where the paint concentrate mixes with water under pressure immediately prior to exiting the apparatus through the spray nozzle;

d. Directing the spray nozzle toward a paintable surface;

e. Upon completing a painting period, turning the valve to block concentrate flow from the reservoir.

11. The method of claim 10 wherein the step of passing clear water through the mixing chamber and nozzle without receiving flow of concentrate from the reservoir valve includes the step of adjusting the valve to a second position that allows water to flow from the water attachment fixture through the mixing chamber and out the spray nozzle while simultaneously blocking flow from the reservoir to the mixing chamber.

12. The method of applying water dilutable paint onto a paintable surface comprising the following steps:

a. maintaining paint concentrate apart from water prior to application;

b. establishing a source of water under pressure;

c. simultaneously as the water is applied to a paintable surface, combining said paint concentrate with said water into a water dilutable paint composition capable of application to a paintable surface to form a dry film of paint on or absorbed into the surface.

13. A portable paint spray gun for spraying water dilutable paint and adapted to mix, within the spray gun, a paint concentrate and water flowing through the spray gun to form a paint suitable for application to a paintable surface only immediately prior to spraying the mixed paint to that paintable surface, comprising, a reservoir sealable against water under valve control containing water-dilutable paint concentrate which paint concentrate includes a paint resin and a paint pigment, configured to deny access of water to the concentrate while the concentrate is within the reservoir, a mixing chamber in fluid communication with the valve with the valve between the reservoir and the mixing chamber regulating flow of concentrate from the reservoir, a valve providing fluid communication between the mixing chamber and the reservoir through a valve tube;

a water attachment fixture in fluid communication with the mixing chamber to which a water conduit may be attached and through which water may be delivered under pressure, a spray nozzle including a first spray nozzle in fluid communication with the mixing chamber through which said paint concentrate is sprayed, and a second spray nozzle, wherein the paint concentrate is stored waterless and water-tight in the reservoir until time of application at which time the paint concentrate flows from the reservoir through the valve and into the mixing chamber when the valve is in a first, or open, position therein mixing with water when said water conduit is attached to said water attachment fixture with water delivered under pressure through said water conduit forming a water dilutable paint composition of suitable concentration capable of application to a paintable surface to form a dried coating of paint, and and further comprising a first and second passageways each providing fluid communication between the water attachment fixture and the first spray nozzle and ending in said first and second spray nozzles, respectively, said first passageway including said mixing chamber and in sealable fluid communication with said reservoir, regulated by said valve, and wherein said valve comprises an integral multiple-position valve including a first, or open, position providing open fluid communication between the reservoir and the mixing chamber in said first passageway while directing fluid flow through said first passageway between said water attachment fixture and said first spray nozzle, a second, or closed, position wherein fluid combination between the reservoir and the mixing chamber is closed by action of said valve while still directing fluid flow between said water attachment fixture and said first spray nozzle, and a third position directing fluid flow between the water attachment fixture and said second spray nozzle.

14. The portable paint spray gun of claim 13 wherein said mixing chamber, valve, water attachment fixture and spray nozzle comprise a spray head that attaches to the reservoir, the water attachment fixture at a spray head first end and the spray nozzle at a spray head second end, and the integral three-way valve comprises a valve stem in a head vertical bore, the valve stem including a channel divider that divides a straight passageway from the water attachment fixture into said first and second passageways, ending in first and second spray nozzles, respectively, said valve stem selectively turning in said vertical bore between said first, second and third positions.

15. The portable paint spray gun of claim 14 wherein said valve further comprises a valve slide with a vertical hole therethrough that slides transverse to said valve tube between the first passageway and the reservoir between open and closed positions in a head channel that runs from the valve tube to the head vertical bore, the vertical hole aligning with the valve tube when the valve is in said open position, establishing fluid communication between the reservoir and the first passageway, and in nonalignment with the valve tube in said second and third valve positions, closing fluid communication between the reservoir and the first passageway.

16. The portable paint spray gun of claim 15 wherein said valve slide further comprises a rack at its end intersecting the head vertical bore, said valve stem fitting snugly in the head vertical bore and including a pinion on its bottom end that meshes with the valve slide rack such that as the valve stem turns between selective first, second and third positions, the valve pinion engages the valve slide rack causing the valve slide to slide in the channel bringing the valve hole into and out of alignment with the valve tube.

17. A portable paint spray gun comprising a spray head including a water attachment fixture, first and second spray nozzles, and first and second through passageways ending in the respective spray nozzles with water selectively directable through either or both passageways from the water attachment fixture to the respective spray nozzles without mixing of fluid between the passageways prior to emerging through the respective spray nozzles, the first passageway adapted to receive and mix paint concentrate with water from said water attachment fixture resulting in paint sprayed from said first spray nozzle suitable for application to a paintable surface.

18. The portable paint gun of claim 17 further comprising a reservoir secured to said spray head in fluid communication with said first passageway and sealable against water under valve control containing water-dilutable paint concentrate, configured to deny access of water to the concentrate while the concentrate is within the reservoir.

* * * * *